US005910031A

United States Patent [19]

Goto

[11] Patent Number: 5,910,031

[45] Date of Patent: Jun. 8, 1999

[54] WIRE TO BOARD CONNECTOR

[75] Inventor: Kazuhiro Goto, Markham, Canada

[73] Assignee: The Whitaker Corporation, Wilmington, Del.

[21] Appl. No.: 08/766,197

[22] Filed: Dec. 12, 1996

Related U.S. Application Data

[60] Provisional application No. 60/008,594, Dec. 13, 1995.

[51] Int. Cl.[6] ..... H01R 13/514

[52] U.S. Cl. ..... 439/752.5; 439/329; 439/595

[58] Field of Search ..... 439/752.5, 746, 439/744, 595, 421, 423, 78, 82, 83

[56] References Cited

U.S. PATENT DOCUMENTS

| | | | |
|---|---|---|---|
| 3,083,345 | 3/1963 | Scheller | 439/452.5 |
| 4,946,408 | 8/1990 | Garrett et al. | 439/872 |
| 5,564,954 | 10/1996 | Wurster | 439/82 |
| 5,630,733 | 5/1997 | Jinno et al. | 439/595 |
| 5,664,969 | 9/1997 | Peterson et al. | 439/752.5 |

OTHER PUBLICATIONS

IBM Technical Disclosure Bulletin, vol. 38, No. 2, (Feb. 1995) p. 207.

*Primary Examiner*—Neil Abrams
*Assistant Examiner*—Eugene G. Byrd

[57] ABSTRACT

The invention comprises an electrical connector having a housing with a front face and a mounting face opposite to the front face. A plurality of contact receiving cavities extend longitudinally through the housing from the front fact to the mounting face. The cavities have side walls and slots extending laterally from the side walls from the front face partially through the housing. A contact is received in the cavity. The contact has wings extending from sides thereof. The wings being received into the slots providing alignment and stability of the contact and to prevent rotation of the contact in the cavity. The invention also comprises an electrical contact, having a body with a wire crimping section, an intermediate section, and a forward contacting section. A latching arm is disposed along the forward section. Wings extend laterally from the intermediate section to engage slots in a housing and provide alignment stability of the body within the housing and to prevent rotation of the body.

15 Claims, 3 Drawing Sheets

WIRE TO BOARD CONNECTOR

This application claims the benefit of U.S. Provisional Application(s) No(s). 60/008,594, Filed Dec. 13, 1995.

FIELD OF THE INVENTION

The invention relates to an electrical connector for providing connection to a circuit board and to the contact therein.

BACKGROUND OF THE INVENTION

A wire can be electrically connected to a circuit board by means of a contact terminal such as the AMP-IN terminal, trademark of AMP Incorporated. The terminal has an insulation crimping section, a conductor crimping section, and a latching arm. The terminal is first crimped to a wire and then is inserted through a hole in the circuit board and the latching arm engages the surface of the board opposite to the side in which it was inserted. The terminal is then soldered to the board thereby forming a permanent electrical and mechanical connection.

Each of these terminals must be individually inserted into the circuit board for electrical connection therewith. It would be an advantage to provide a connector housing to hold a plurality of the terminals so that they can all be inserted at the same time. It would also be an advantage to provide a terminal that is secured within the housing for alignment and stability and to prevent rotation of the terminal within the housing

SUMMARY OF THE INVENTION

The invention comprises an electrical connector having a housing with a front face and a mounting face opposite to the front face. A plurality of contact receiving cavities extend longitudinally through the housing from the front fact to the mounting face. The cavities have side walls and slots extending laterally from the side walls from the front face partially through the housing. A contact is received in the cavity. The contact has wings extending from sides thereof. The wings being received into the slots providing alignment and stability of the contact and to prevent rotation of the contact in the cavity.

The invention also comprises an electrical contact, having a body with a wire crimping section, an intermediate section, and a forward contacting section. A latching arm is disposed along the forward section. Wings extend laterally from the intermediate section to engage slots in a housing and provide alignment stability of the body within the housing and to prevent rotation of the body.

BRIEF DESCRIPTION OF THE DRAWINGS

Embodiments of the present invention will now be described with reference to the accompanying drawings, in which.

DETAILED DESCRIPTION OF THE DRAWINGS

Figure 1:
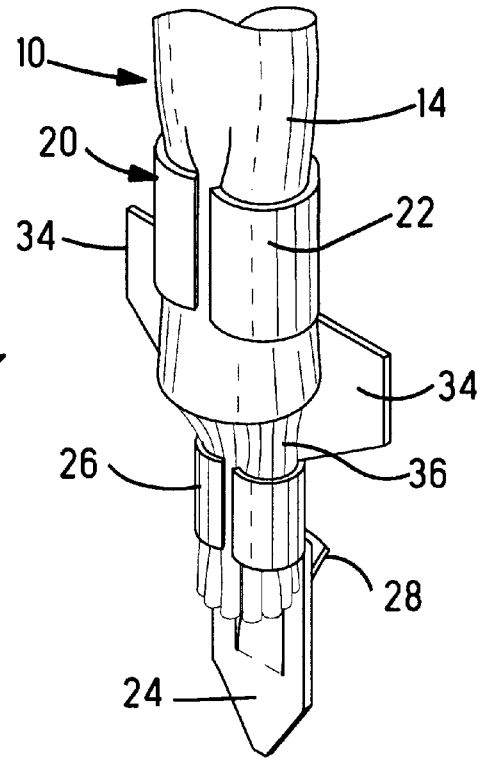
FIG. 1 is an isometric view of the terminal of the present invention.

FIG. 1 shows the contact terminal 20 of the present invention. The terminal 20 is electrically connected to a wire 10 having an outer insulating jacket 14 and inner conductors 12. The ends of the insulating jacket 14 are stripped away so that the conductors can be connected to the terminal 20.

The terminal 20 includes an insulation crimping section 22, a contact section 24, a conductor crimping section 26 and a latching arm 28. The insulation crimping section 22 has arms which are crimped around the insulating jacket 14 of the wire 10. The crimping section 26 has arms which are crimped on the exposed conductors 12. An intermediate portion 36 of the terminal 20 has two wings 34 extending laterally. The wings 34 act as anti-rotation wings and also as alignment wings for the terminal 20.

Figure 2:
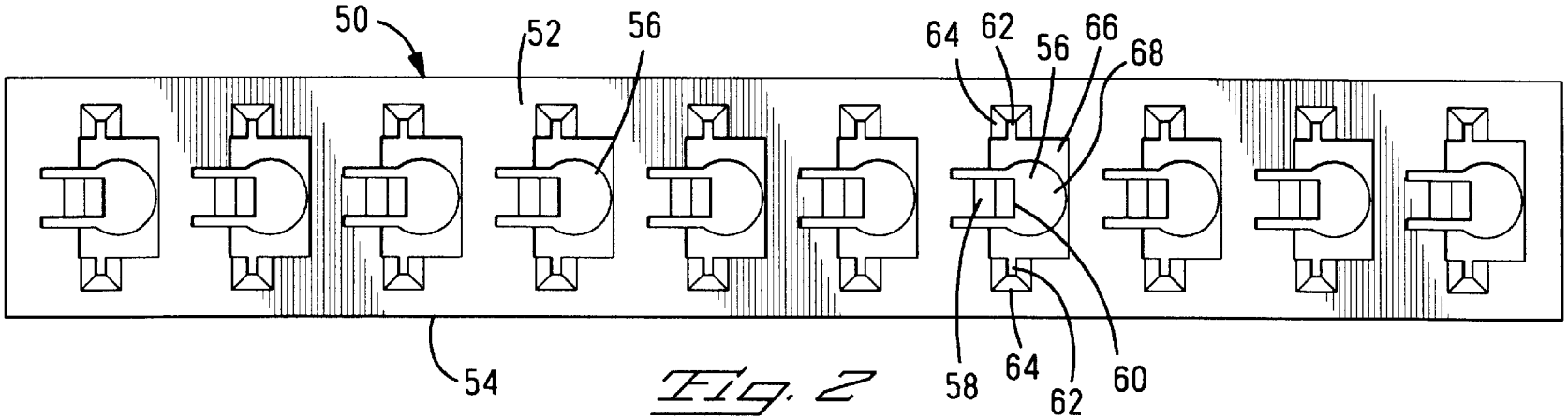
FIG. 2 is a top view of the connector housing of the present invention.

The terminal 20 provides electrical connection from the wire 10 to traces on a circuit board 40 after the terminal is inserted in a through hole on the circuit board and then soldered to the circuit board. In order to provide a method of connecting several terminals 20 to the circuit board 40 at the same time, a plurality of terminals are inserted into housing 50. FIG. 2 shows a top view of the housing 50. The housing has a top side 52, and a bottom side 54. A plurality of contact receiving cavities 56 extend through the housing from the top side 52 to the bottom side 54. A latching arm 58 extends from the top side through the cavity 56 and has a projection 60 along its lower end. The cavities 56 each have two slots 62 which extend laterally from the cavity 56. The slots 62 have chamfered surfaces 64 leading into the slot from the top side 52. The slots 62 extend from the top side 52 of the housing through to a shelf 66 within the cavity 56. The shelf extends around a portion of the cavity 56 and has a hole 68 extending therethrough to the bottom side of the housing.

Figure 3:
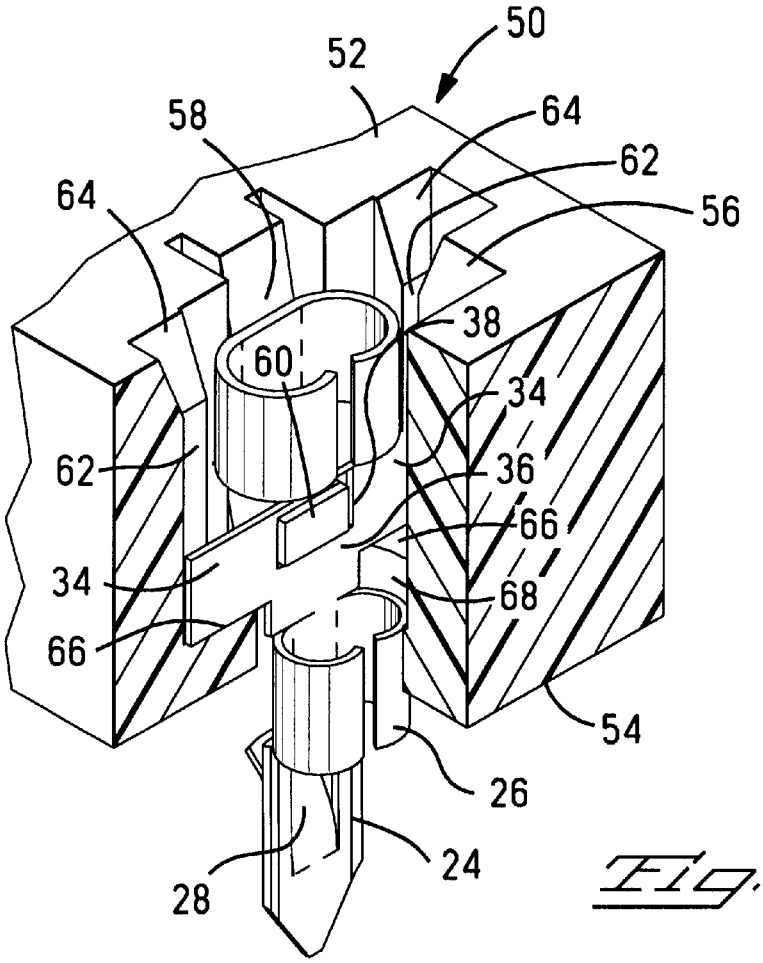
FIG. 3 is an isometric view with a partial cross sectional view of the housing with the terminal mounted therein.

FIG. 3 shows a partial cross sectional view of the housing with a terminal 20 inserted therein. The wire 10 is not shown crimped to the terminal 20 for purposes of simplicity, but it is to be understood that the terminal 20 would be crimped onto the wire before being inserted into the housing. As can be seen in this view, the terminal has a window 38 along the rearward portion 30 of the terminal 20. The projection 60 from the latching arm is received within the window 38 to latch the terminal 20 in place within the cavity 56. The intermediate portion 36 is flat and the wings extend from the intermediate portion in the same plane as the intermediate portion. While the representative embodiment shows a flat intermediate portion, it is possible that the the intermediate portion could be curved or some other shape and the wings could be other than planar or not planar with the intermediate portion. When the terminal is being inserted into the cavity 56, the wings 34 are received between the chamfered surfaces 64 and into the slots 62. The wings 34 are inserted in until they abut against the shelf 66. The combination of the interactions of the latching arm 58 and the shelf 66 secure the terminal 20 within the cavity 56. The crimping section 26 is received through the central hole 68 and the contacting section 24 and the latching arm 28 pass through the housing and are received along the bottom side 30 of the housing.

Figure 4:
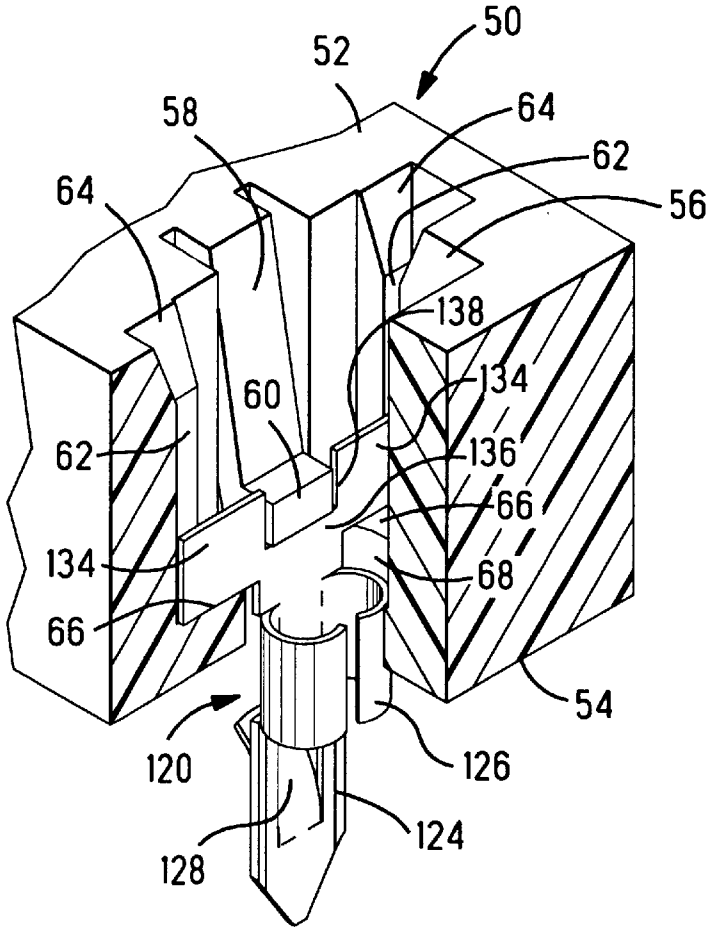
FIG. 4 is an isometric view with a partial cross sectional view of the housing with an alternative embodiment of the terminal mounted therein.

FIG. 4 shows an alternative embodiment of the contact terminal 120. The terminal 120 is shown in the housing 50 without the wire 10 for simplicity purposes. It is to be understood that the terminal 120 would be crimped to the wire 10 before the terminal is inserted into the housing. The terminal 120 is essentially the same as the terminal 20 except that it is missing the insulation crimping section. The terminal 120 has an intermediate portion 136 with wings 134 extending laterally therefrom. The intermediate portion 136 is substantially flat and the wings 134 extend therefrom in the same plane as the intermediate portion. While this representative embodiment also shows a flat intermediate portion, it is possible that the the intermediate portion could be curved or some other shape and the wings could be other than planar or not planar with the intermediate portion. The crimping section 126 includes two arms which are crimped around the conductors of the wire to form an electrical connection therewith. A contact section 124 has a latching arm 128.

The intermediate portion 136 has a notch 138 instead of the window 38 of terminal 20. The notch 138 is open to the top of the terminal 120. The projection 60 of the latching arm 58 is received within the notch 138 to secure the terminal 120 in place within the cavity 56. The wings 134 behave in the same manner as the wings 34. The wings 134 are received between the chamfered surfaces 64 and are directed into the slot 62. The terminal 120 is pushed into the housing until the wings 134 abut against the shelf 66. The combination of the interactions of the latching arm 58 and the shelf 66 secure the terminal 120 within the cavity 56. The crimping section 126 is received through the central hole 68 and the contacting section 124 and the latching arm 128 are received along the bottom side 30 of the housing.

The terminals 20, 120 are first crimped to wires 10. A plurality of terminals are then inserted into the housing from the top side 52. The latching arm 58 is deflected during insertion of the terminal until the terminal is fully seated within the cavity 56. The latching arm 58 then resiles back to its original position thereby latching the terminal in place within the cavity.

Figure 5:
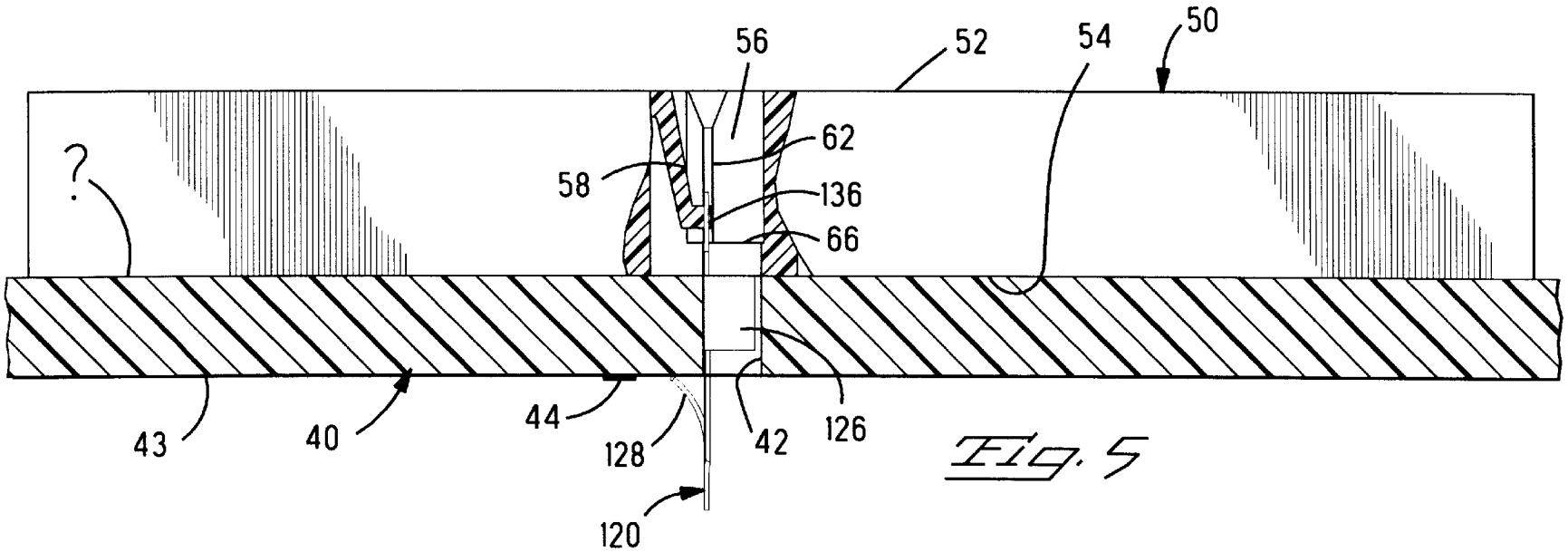
FIG. 5 is a partial cross sectional view of the housing mounted onto a circuit board.

Once all of the terminals are fully in place, the housing is then mounted onto the circuit board 50, as is seen in FIG. 5. The circuit board has a plurality of through holes 42, only one of which is shown for illustrative purposes. The circuit board has a top side 41 and a bottom side 43. Along the bottom side 43 are circuit traces 44.

FIG. 5 shows the housing 50 mounted to the circuit board 40. The housing has terminal 120 mounted therein, but the terminal 120 is shown without the wire for simplicity. Only one terminal 120 is shown for simplicity, but it should be understood that there would be a plurality of terminals within the housing to be received through a plurality of through holes 42 on the circuit board. The bottom side 54 of the housing 50 is mounted against the top side 41 of the circuit board. The crimping section 126 of the terminal, and the conductors contained therein, are received through the through hole 42. The latching arm 128 and the contacting section 124 are received along the bottom side 43 of the circuit board. The latching arm 128 is received along the bottom side 43 of the circuit board to latchably secure the terminal 120 and the housing 50 to the circuit board 40. The end of the terminal 120 is received through the through hole along the bottom side of the circuit board is then soldered in to place providing a permanent electrical and mechanical connection with the traces on the circuit board.

The wings 134 on the terminal 120 prevent the terminal from rotating within the housing prior to soldering to the circuit board. The wings 134 also insure that the terminal 120 is properly aligned with the through hole 42 on the circuit board. The wings 134 also provide stability to the terminal 120 while it is mounted in the housing.

Figure 6:
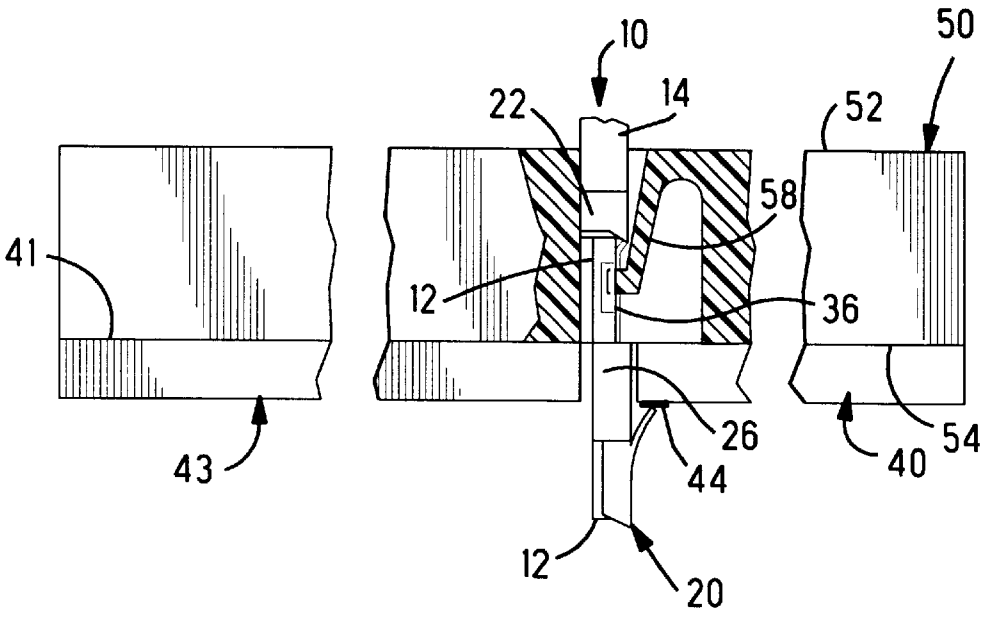
FIG. 6 is a partial cross sectional view of the housing mounted onto a circuit board with the first terminal mounted therein.

FIG. 6 shows the housing 50 mounted to the circuit board 40. The housing has terminal 20 therein. As in FIG. 5, only one terminal is shown for simplicity, however, terminal 20 is shown crimped to wire 20. The latching arm 28 of the terminal 20 is received along the bottom side 43 of the circuit board to provide temporary retention of the housing to the circuit board 40 prior to soldering the terminals to the board. The crimping section 26 is received through the through hole 42 along with the conductors 12 captured therein. The latching arm 28 is received along the bottom side 43 of the circuit board to latchably secure the terminal 20 and the housing 50 to the circuit board 40. The end of the terminal 120 is received through the through hole along the bottom side of the circuit board is then soldered in to place providing a permanent electrical and mechanical connection with the traces on the circuit board.

The connector of the current invention provides for inserting a plurality of terminals into through holes on a circuit board simultaneously. Further, the wings on the terminals provide for alignment and stabilization of the terminal, and prevent the terminal from being rotated within the housing.

It is thought that the electrical connector and the terminal of the present invention and many of its intended advantages will be understood from the foregoing description It is apparent that various changes may be made in the form, construction, and arrangement of parts thereof, without departing from the spirit or scope of the invention without sacrificing all of its material advantages.

I claim:

1. An electrical connector, comprising:

a housing having a front face and a mounting face opposite to the front face, a plurality of contact receiving cavities extend longitudinally through the housing from the front fact to the mounting face, the cavities have side walls and slots extending laterally from the side walls from the front face partially through the housing; and a contact to be received in the cavity, the contact having a flat intermediate portion, the contacts having flat wings extending from sides of the intermediate portion thereof, the wings being in the same plane as the intermediate portion, the wings being received into the slots providing alignment and stability of the contact and to prevent rotation of the contact in the cavity.

2. The electrical connector of claim 1, wherein the contact extends out the mounting face of the housing and the housing is mounted onto a circuit board, the contact being received through a through hole on the circuit board to provide electrical connection to traces on the circuit board.

3. The electrical connector of claim 2, wherein the contact has a forward connecting section with a latching arm thereon, the latching arm engaging a surface of the circuit board which is opposite to the surface upon which the housing is mounted.

4. The electrical connector of claim 3, wherein the contact has a crimping section and an intermediate section, the intermediate section having a notch to receive a projection from a latching arm in the housing.

5. The electrical connector of claim 3, wherein the contact has a crimping section, an insulation crimping section, and intermediate section therebetween, the wings extend from the intermediate section and the intermediate section has a window through which a projection from a latching arm in the housing extends to latchably secure the contact within the housing.

6. The electrical connector of claim 1, wherein the cavity has a latching arm with a projection thereon to engage the contact and to latchably secure the contact within the housing.

7. The electrical connector of claim 6, wherein the cavity has a shelf, the slots extend through the housing to the shelf, the wings engage the shelf preventing the contact from moving further into the housing.

8. The electrical connector of claim 7, wherein the contact has an opening to receive the projection on the latching arm, the latching arm and the shelf cooperating to secure the contact within the housing.

9. The electrical connector of claim 1, wherein the contact has a flat intermediate section, the wings extending from the intermediate section in the same plane as the intermediate section.

10. An electrical contact, comprising:

a body having a wire crimping section, a flat intermediate section residing in a plane, and a forward contacting section;

a latching arm being disposed along the forward section; and wings extending laterally from the intermediate section to engage slots in a housing and provide alignment stability of the body within the housing and to prevent rotation of the body, the wings being flat and extending in the same plane as the plane of the intermediate section.

11. The contact of claim 10, wherein the body is to be inserted into a through hole on a circuit board, the latching arm engages traces on the side of the circuit board opposite to side from which the contact is inserted, the latching arm providing a temporary mechanical connection to the traces on the circuit board.

12. The contact of claim 10, wherein intermediate section is flat and the wings extend from the intermediate section in the same plane as the intermediate section.

13. The contact of claim 12, further comprising an insulation crimping section attached to the intermediate section.

14. The contact of claim 13, wherein the intermediate section has an opening to receive a projection on a latching arm within the connector housing.

15. The contact of claim 12, wherein the intermediate section has an opening to receive a projection on a latching arm within the connector housing.

* * * * *